United States Patent [19]

Törneman et al.

[11] Patent Number: 4,992,065

[45] Date of Patent: Feb. 12, 1991

[54] REVERSING DEVICE OF A JET PROPULSION ASSEMBLY FOR A SHIP

[75] Inventors: Gerard Törneman, Gimo; Nils E. Lundberg, Österbybruk, both of Sweden

[73] Assignee: MJP Marine Jet Power AB, Osthammar, Sweden

[21] Appl. No.: 435,415

[22] PCT Filed: May 20, 1988

[86] PCT No.: PCT/SE88/00270

§ 371 Date: Nov. 16, 1989

§ 102(e) Date: Nov. 16, 1989

[87] PCT Pub. No.: WO88/09288

PCT Pub. Date: Dec. 1, 1988

[30] Foreign Application Priority Data

May 21, 1987 [SE] Sweden ..... 8702122

[51] Int. Cl.[5] ..... B63H 11/11

[52] U.S. Cl. ..... 440/41; 440/38

[58] Field of Search ..... 440/38, 40–43; 60/221, 222; 239/265.19, 265.25, 265.29, 265.39; 244/110 B

[56] References Cited

U.S. PATENT DOCUMENTS 2,735,264 2/1956 Jewett ..... 244/110 B
3,531,940 10/1970 Markowski ..... 239/265.39
4,212,442 7/1980 Fage ..... 244/110 B

FOREIGN PATENT DOCUMENTS 607075 4/1960 Italy .
449207 4/1987 Sweden .

*Primary Examiner*—Joseph F. Peters, Jr.
*Assistant Examiner*—Edwin L. Swinehart
*Attorney, Agent, or Firm*—Witherspoon & Hargest

[57] ABSTRACT

A reversing device of a jet propulsion assembly for ships. The jet propulsion assembly includes a steering means connected to the outlet of a pump, for steering the driving water jet, the steering means including two flaps for reversing the driving water jet. An actuator pivots a first flap downwards around a first bearing across the water jet, at the same time as link arms, which are journalled between the front edges of the first flap and second flap, swing the second flap around a second bearing. The rear portion of the second flap is thereby raised towards the water jet and encounters the inner side of the first flap in such a way that both flaps shut off the passage rearwards and divert the water jet obliquely downwards/forwards. The two flap bearing points on the steering means together with the link arm bearing points on the two flaps provide an equilibrium of forces between the actuator pressure on the first flap and water jet pressure on both flaps, under the condition that a reduction of the pressure on the actuator results in the first flap being swung upwards by the water pressure.

1 Claim, 3 Drawing Sheets

REVERSING DEVICE OF A JET PROPULSION ASSEMBLY FOR A SHIP

The present invention relates to a jet propulsion assembly for ships, and in particular to a reversing device of such assemblies.

A jet propulsion assembly for ships basically includes a propeller pump, which generally is mounted at the ships stern and has an inlet connected to an inlet opening in the bottom of the ship, forward of the pump. The propeller pump outlet is generally connected to a steering means, which is laterally pivotal around a vertical axle for steering the driving water jet, and connected to a reversing device adapted to be raised and lowered around a horizontal axle for diverting the driving water jet from straight or obliquely rearwards, or straight or obliquely forwards/downwards.

The reversing device of the jet propulsion assembly is normally constructed so that one or several shovel-shaped members can be pivoted horizontally into the driving water jet from the pump to gradually divert the jet. The shovel-shaped members and their suspension points in relation to the steering means and pump are normally positioned so that the water jet will lock the shovel-shaped members in their maximally pivoted positions, in which the water jet is directed obliquely forwards/downwards. Such a known reversing device is disclosed by for example the Swedish patent application No. 8200417-7. This has, as do similar reversing devices, the disadvantage that a considerable force is required to return the shovel-shaped members to their original positions, in which the jet can pass freely straight backwards. It is appreciated that this can give rise to certain risks as the ship is being manoeuvered to change from reverse drive to forward drive. The jet is constantly counteracting the opening of the shovel-shaped members, which can lead to that the ship continues to drive backwards, despite the intention to drive the ship forwards.

The purpose of the present invention is to overcome the above problems and to provide a reversering device of a jet propulsion assembly for ships, wherein the outgoing jet does not strive to lock the shovel-shaped members in their maximally reset positions, at the same time as it effectively diverts the water jet gradually as required.

The object of the invention as well as the characteristic feature thereof appear from the accompanying patent claims.

Figure 1A:
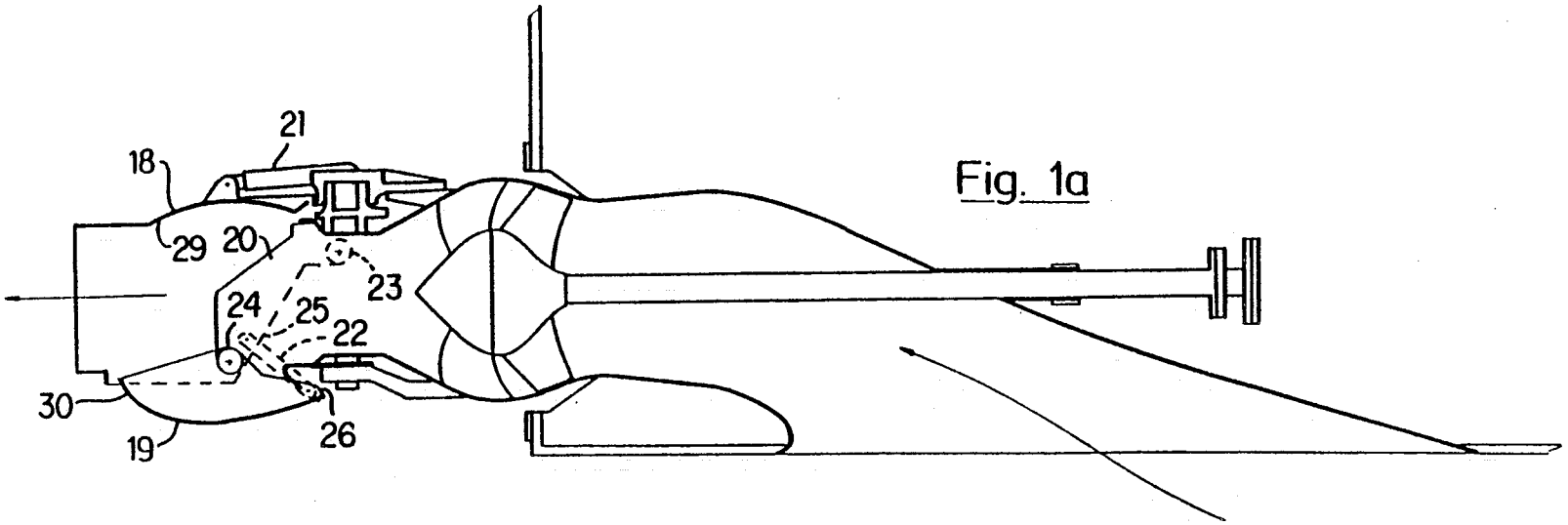
Figure 1B:
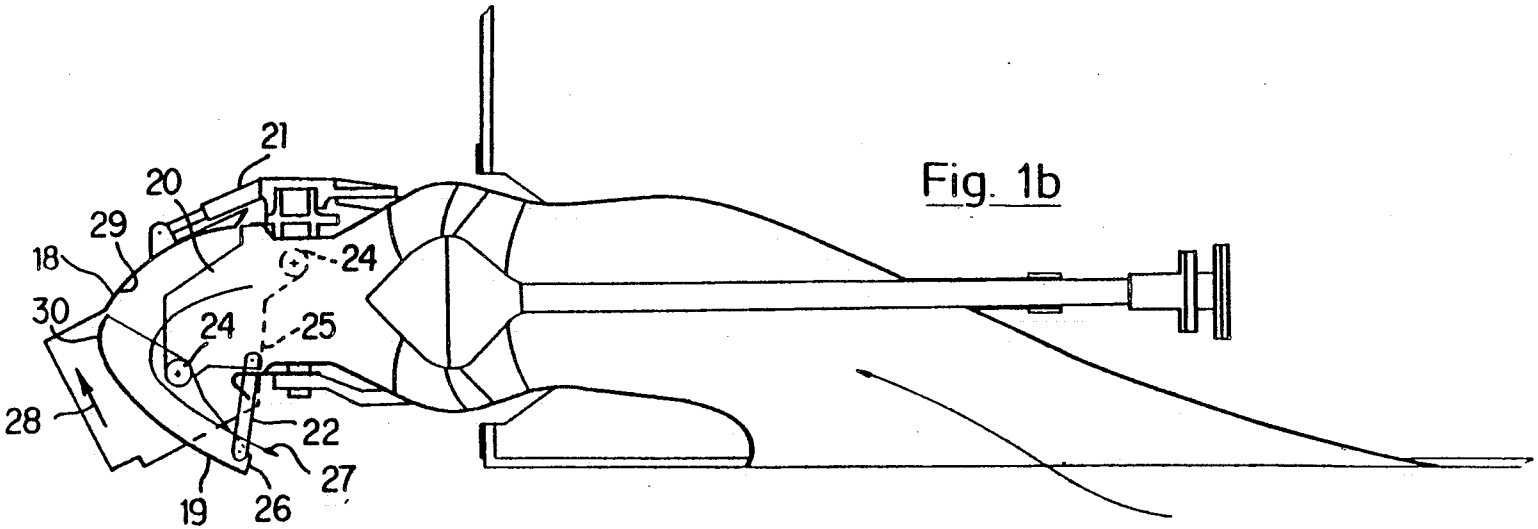
Figure 2:
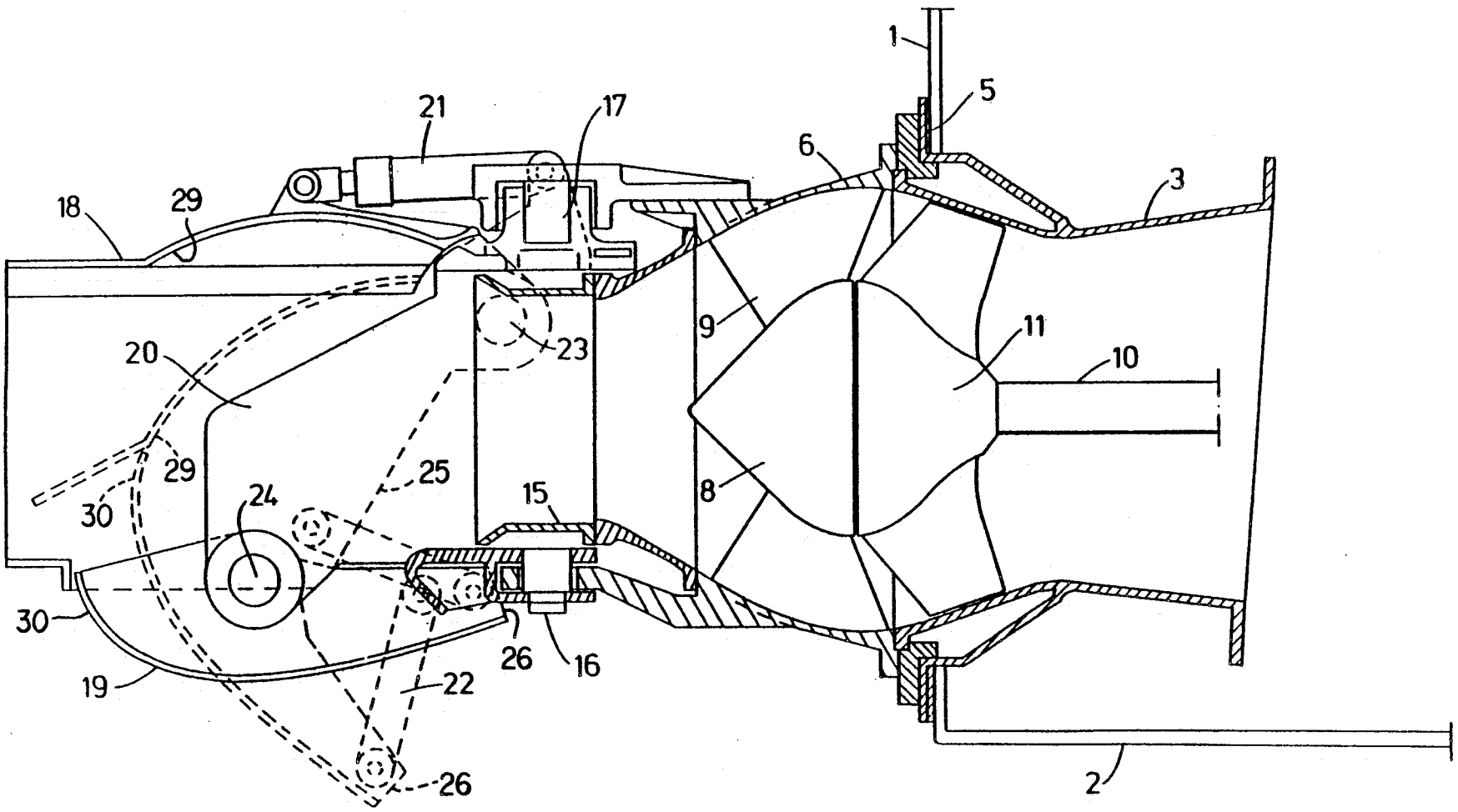
Figure 3:
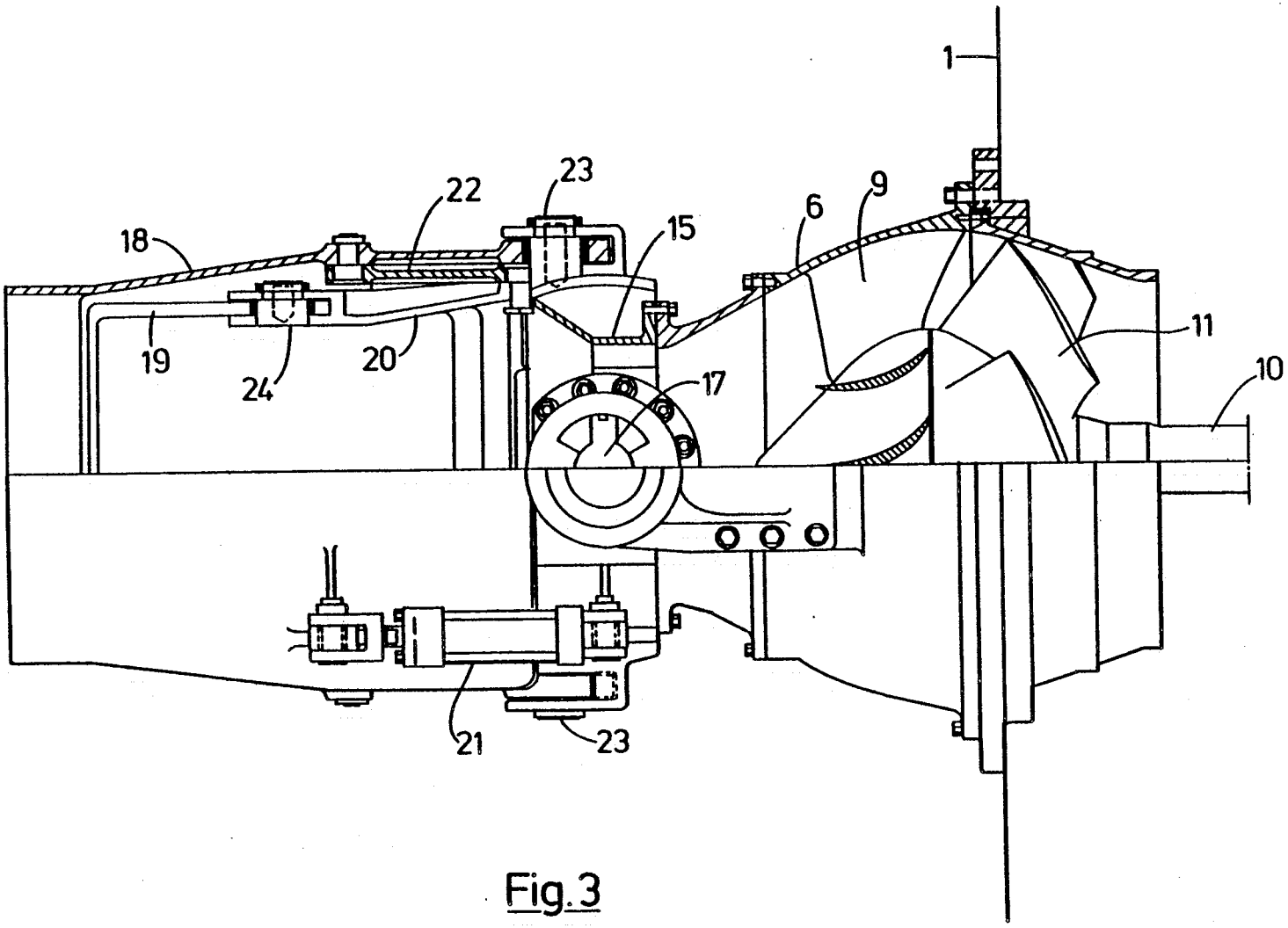

The invention will be further described below, in conjunction with the attached drawings, wherein FIG. 1*a* is a schematical longitudinal section of a jet propulsion assembly with a reversing device according to the invention, wherein the reversing device is shown in its inactive state, FIG. 1*b* is a view corresponding to FIG. 1*a*, and showing the reversign device in its fully reversing state, FIG. 2 is a schematic, vertical section of the rear portion of a jet propulsion assembly, where the reversing device according to the invention is illustrated by full lines in its inactive state, and by dashed lines in its fully reversing state, and FIG. 3 is a partially sectioned top view of the jet propulsion assembly in FIG. 2.

The jet propulsion assembly according to the drawings is schematically shown in its position at the stern of a ship, of which only the stern 1 and bottom 2 are implied. The jet propulsion assembly includes an inlet canal 3 extending from a water inlet 4 in the ship bottom 2 to a mounting flange 5 for the pumping house 6 of the assembly. The inlet 4 is provided with a grid 7, which prevents objects from being sucked into the jet propulsion assembly. The pump is comprised of a propeller pump having a hub casing 8, which is provided centrally in the flow way through the pumping house 6. The hub casing 8 is supported by articulated vanes 9. The pump wheel 11 is journalled in the hub casing 8 and is driven from a not further shown driving machinery in the ship by a drive shaft 10.

The outlet side of the pump housing 6 is connected to an outlet pipe 15, over which a laterally pivotal steering means 20 is mounted. The steering means 20 is journalled in vertically positioned axle spindles 16 and 17 and is laterally swiveled around these by means of not further represented hydraulic engines. The steering of the ship takes place when the water jet from the pump is diverted to either side of the inner walls of the steering means 20. To reverse the force direction of the assembly, when retardation or backing up of the ship is required, there are provided two flaps 18, 19, which are pivotal into the water jet in such a way that this is gradually diverted from full speed ahead, the jet being directed straight rearwards, to full speed rearwards, the jet being directed obliquely downwards/forwards. Between the above positions can, if so desired, intermediate positions be obtained in which the jet partially travels forwards and partially rearwards. The upper flap 18 also has a function to act as a splash shield, the upper flap 18 overlapping the rear edge and sides of the lower flap 19. By means of this reversing device, steering can be attained also during backing operations, in that the steering means 20 is pivotal so that the jet is diverted in the direction wanted.

The upper flap 18 is journalled to the steering means 20 by means of horizontally positioned axle spindles 23. The lower flap 19 is journalled to the steering means 20 by means of horizontally positioned axle spindles 24. The upper flap 18 is connected to the lower flap 19 as depicted in, for example, FIGS. 1*a* and 1*b*, by link arm 22 which is journalled in the front edges 25, 26, respectively of the flaps 18 and 19. By pivoting the upper flap 18 downwards about axle spindles 23, in the direction of arrow 27, by means of the reversing device 21, a downward force is transmitted through the link arm 22 to the front edge 26 of the lower flap 19 as depicted in FIG. 16. This lower flap is swiveled around the axle spindles 24 in the upward direction of arrow 28 and encounters the inner wall 24 of the upper flap 18 with its rear edge 30, which results in the water jet being diverted forwards at the same time as the resulting pressure on the inner walls of the flaps 18 and 19 strives to counteract said diversion.

The present invention thus provides a reversing device that meets the initially mentioned purpose.

What is claimed is:

1. Reversing device of a jet propulsion assembly for a ship, comprising a steering means connected to an outlet side of a pump, for steering a driving water jet, said steering means including two flaps for reversing the driving water jet, said flaps being provided so that an actuator pivots a fist of said two flaps down and around a first flap bearing across the water jet at the same time as link arms, which are mounted on link bearings, and extend between front edges of said two flaps, swing a second flap of said two flaps around a second flap bearing whereby a rear portion of the second flap is raised towards the water jet and encounters an inner side of the first flap in such a way that said two flaps jointly shut off rearwards water passage, diverting the water jet obliquely downwards/forwards, characterized in that said two flaps bearing points on said steering means together with the link arm bearing points on said two flaps provide an equilibrium of forces between actuator pressure on the first slap and water jet pressure on said two flaps under the condition that a reduction of pressure on the actuator results in the first lap being swung upwards by water pressure.

* * * * *